US007178445B2

(12) United States Patent
Wulvik et al.

(10) Patent No.: US 7,178,445 B2
(45) Date of Patent: Feb. 20, 2007

(54) BALLISTIC PROTECTION

(75) Inventors: Erik Wulvik, Skedsmokorset (NO); Odd Halsnes, Båstad (NO); Haakon Fykse, Enebakkneset (NO)

(73) Assignee: Forsvarets Forskningsinstitutt (NO)

( * ) Notice: Subject to any disclaimer, the term of this patent is extended or adjusted under 35 U.S.C. 154(b) by 0 days.

(21) Appl. No.: 10/533,128

(22) PCT Filed: Oct. 28, 2003

(86) PCT No.: PCT/NO03/00359

§ 371 (c)(1),
(2), (4) Date: Apr. 29, 2005

(87) PCT Pub. No.: WO2004/040228

PCT Pub. Date: May 13, 2004

(65) Prior Publication Data

US 2006/0027088 A1 Feb. 9, 2006

(30) Foreign Application Priority Data

Oct. 31, 2002 (NO) ..... 20025233

(51) Int. Cl.
*F41H 5/04* (2006.01)

(52) U.S. Cl. ..... 89/36.02

(58) Field of Classification Search ..... 89/36.02
See application file for complete search history.

(56) References Cited

U.S. PATENT DOCUMENTS 3,604,374 A 9/1971 Matson et al.
4,194,431 A * 3/1980 Markus et al. ..... 89/36.02
4,321,777 A * 3/1982 Sauret et al. ..... 52/308
4,836,079 A * 6/1989 Barrett ..... 86/50
5,536,686 A * 7/1996 Chung ..... 501/111
5,767,435 A 6/1998 Reymann
6,012,162 A * 1/2000 Bullat ..... 2/2.5
6,068,889 A 5/2000 Seeman
6,200,664 B1 3/2001 Figge

* cited by examiner

*Primary Examiner*—Stephen M. Johnson
(74) *Attorney, Agent, or Firm*—Connolly Bove Lodge & Hutz, LLP; Larry J. Hume

(57) ABSTRACT

The present invention relates to ballistic protection for use in personal equipment or in vehicles of various types such as cars, helicopters and boats or for use in permanent or temporary protection of various types in buildings or other fixed or mobile installations. The ballistic protection according to the present invention can be employed as protection against various kinds of low or high-velocity projectiles in addition to which it will be capable of offering protection against splinters and various kinds of fragments which could other wise injure people or damage vehicles or installations if they had the opportunity of penetrating right through an external protective layer. The ballistic protection according to the present invention can further be combined with a drinking water reservoir since an essential part of the protection is a liquid container. The drinking water supply, for example, for a soldier is thereby improved both with regard to available volume and position/carrying capacity.

8 Claims, 4 Drawing Sheets

BALLISTIC PROTECTION

CROSS REFERENCE TO RELATED APPLICATIONS

This application is a U.S. National Stage entry under 35 U.S.C. § 371 of co-pending International Patent Application No. PCT/NO2003/000359, filed on Oct. 28, 2003 by WULVIK, Erik et al. entitled BALLISTIC PROTECTION, the entire contents of which is incorporated by reference. As in the parent International Application No. PCT/NO2003/000359, priority is also claimed to Norway Patent Application No. 20025233, filed on Oct. 31, 2002, the entire contents of which is incorporated by reference and for which priority is claimed under 35 U.S.C. § 119.

SUMMARY

The present invention relates to ballistic protection for use in personal equipment or in vehicles of various types such as cars, helicopters and boats or for use in permanent or temporary protection of various types in buildings or other fixed or mobile installations. The ballistic protection according to the present invention can be employed as protection against various kinds of low or high-velocity projectiles in addition to which it will be capable of offering protection against splinters and various kinds of fragments which could otherwise injure people and damage vehicles or installations if they had the opportunity of penetrating right through the protection. The ballistic protection according to the present invention is particularly well suited as a protection against high-velocity projectiles and can therefore be employed particularly in threat situations involving the risk of being fired upon by high-velocity projectiles.

The ballistic protection according to the present invention can further be combined with a drinking water reservoir since an essential part of the protection is a liquid container. The drinking water supply, for example, for a soldier is thereby improved both with regard to the volume available and the location/carrying capacity.

The different situations in which such ballistic protection may be particularly applicable involve the police, soldiers and security forces as well as civil guards etc. who are located in a position or situation where there is a reduced requirement for mobility and where they may be fired upon, for example, by high-velocity projectiles. These are also people who may at times have a need for a portable source of drinking water.

The ballistic protection for fixed installations may also be employed, for example, by aid organisations or others in order to protect parts of hospitals, food stores etc. in exposed situations.

The ballistic protection according to the present invention is dynamic since it can be available or not according to the need for protection. Furthermore, the ballistic protection can easily be achieved as an addition to other kinds of ballistic protection. The transition between the various degrees of protection (light and heavier protection) can be implemented quickly and efficiently and an upgrading of existing protection can be performed quickly without particularly sophisticated equipment.

Amongst previously known solutions, we shall refer, e.g., to U.S. Pat. No. 4,485,491, U.S. Pat. No. 4,507,802 and U.S. Pat. No. 5,060,314, all of which relate to different combinations of "plates" (ballistic protective panels) which are placed in pockets or suitable openings in a personal garment in order to protect the user against ballistic projectiles. The "plates" have different properties and construction according to the threat involved and are placed in suitable locations over the body in order to protect vital organs better than peripheral protective measures for protecting limbs, etc.

The disadvantage of such known forms of ballistic protection for personal use is particularly associated with reduced mobility and increased weight. It is therefore desirable to use as "light" a protection as possible while maintaining the capability of upgrading the protection level as required. When upgrading the protection, one is also dependent on having available panels (plates) which suit the clothing or the protective equipment used. Moreover, it may be desirable to have access on a later occasion to those plates that were removed from the protection, which means that they have to be carried and the weight load is therefore still present during transport.

In vehicles such as cars, helicopters, boats, etc. the same relationship exists between increased protection and increased weight. In some situations more protection is required while at the same time accepting higher weight and thereby less load capacity. However, there are not many known systems for upgrading the protection on a vehicle when required, for example upgrading the protection on the bottom (the belly) of a helicopter when it has to fly over areas with increased risk from ground fire.

In many cases, moreover, it may be useful to have a flexible system for upgrading protection which permits an increase in protection in some areas, for example in vital machine parts or in personnel areas.

A projectile with a relatively high velocity, for example a projectile from an automatic weapon such as an AG3 or AK47, which are automatic weapons commonly employed in conflict situations, has a relatively conical shape with a pointed front end and a larger, blunt, rear (following) end. The projectile moves in a circular motion about its longitudinal axis while moving forwards. With regard to personnel injury as a result of impact with a high-velocity projectile, a projectile of this kind has a particularly destructive effect on impact with soft material, especially soft tissue (body tissue). The projectile becomes unstable in its longitudinal direction and turns after impact with the result that the end which was following before impact now becomes the leading end. This creates two effects. Firstly, the projectile causes destruction in an area corresponding to a large proportion of its length since the projectile turns so that the following end comes first. This creates a large area of bleeding within the wound. The projectile then moves on with the largest end first and at the exit from soft tissue it causes a large exit wound, substantially larger than the entry wound.

Traditional ballistic protection attempts to divert the energy in an impact from a projectile by dissipating it over a large area, with the result that pressure per surface unit in the point of impact is greatly reduced. This can be achieved with various kinds of standard ballistic protective plates with ballistic fibres. As extra protection against high-velocity ammunition, additional use is made of so-called hard plates which offer further protection and reduce the velocity and penetrating power of the projectile. These hard plates are generally an upgrading of existing lighter protective equipment. In vehicles and installations it is usually impossible to upgrade with additional hard plates, which moreover are extremely heavy.

There is therefore a need for a form of protection that can be employed when the nature of the threat or the situation indicates that it is necessary, which protection can be removed when no longer required. Furthermore, it should not be dependent on the shape and size of the element to be protected regardless of whether this is a helicopter or a person. It should also be possible to upgrade the protection at short notice without any special logistics of necessary plates and equipment.

BACKGROUND

For this purpose, according to the present invention ballistic protection is provided against projectiles, splinters, sharp objects and the like particularly for personal clothing and equipment as well as for vehicles, vessels, aircraft or fixed installations, which protection consists of at least two substantially plate-shaped protective elements or at least two groups of plate-shaped protective elements. The protection is characterised in that between the two plate-shaped elements or groups of plate-shaped elements are one or more layers of liquid or a liquid-like medium stored in one or more containers.

The idea behind the invention is that a projectile that hits liquid or the like, such as for example water, will behave in the same way as when it hits soft tissue. When the projectile first hits a plate, the velocity is checked, the projectile is further deformed and rapidly becomes unstable. When it subsequently hits a liquid, the projectile turns as mentioned above. The projectile is now considerably easier to capture and stop and when it then hits the second plate-shaped element or group of elements, this element checks and stops the projectile in approximately the same manner as a low-velocity projectile by dissipating the energy in the point of impact over a substantially larger area.

Thus it will be possible to employ the invention in a wide range of different areas of application where a light protection with two "plates" has an intermediate container. If required, the container or desired parts of the container can be filled with a liquid in order to provide increased protection.

The liquid may, for example, be water which is easy to handle while also being easily available.

The liquid container can also be used for storing drinking water and in this connection the container may be provided with a tapping system which permits a person to drink directly from the container.

When the container is empty, moreover, it can be filled with air which will provide increased insulation as well as contributing to buoyancy if required.

If it is very cold the liquid used in the container may have additives, for example alcohol to prevent the formation of ice.

In different embodiments the liquid or the liquid-like medium is stored in one or more rigid containers. Alternatively, the liquid may be stored in one or more flexible containers and in a further embodiment one or more the containers may overlap one another. If it is desirable to fill the space between the plate-shaped elements constantly, a rigid container may be employed. In a rigid container of this kind, however, the liquid will at all times be located at the bottom which does not necessarily provide good enough protection at the desired points. In an alternative embodiment, therefore, the plate-shaped elements may be connected with one or more elastic elements/bodies which draw the elements towards each other, thereby reducing the volume in a flexible container and thus keeping the liquid at a uniform pressure level. Alternatively, the plate-shaped elements can be kept at a fixed distance apart with distance pieces of suitable dimensions. As a combination the distance between the plate-shaped elements can have a lower limit by providing distance pieces with a length between the elements corresponding to the least distance desired between the elements.

In order to ensure that all the liquid is not lost if the container is punctured or damaged, in an embodiment one or more of the containers may also be interconnected in groups where each group of interconnected containers is provided with a device for filling and tapping. Several groups of containers must therefore be filled and tapped. This also offers the possibility for priority protection if a person wishes to use the liquid as a drink.

In a preferred embodiment the container(s) for liquid are therefore releasably mounted between the plate-shaped elements, thus enabling the container(s) to be replaced. This facilitates the possibility of cleaning, etc.

It is preferred, moreover, that the container(s) are provided with a filling means or connection for a filling means, thus enabling them to be transported empty and filled when required. With regard to this it is also preferred that the container(s) are provided with a tapping means or connection for a tapping means. If the container is to be used as a drinking water reservoir, it is preferred that the container(s) is provided with a means or connection for a means that permits the liquid to be drunk by a person.

DESCRIPTION OF THE DRAWINGS

Examples of different embodiments of protection according to the present invention are further indicated in the following figures.

DETAILED DESCRIPTION

Figure 1:
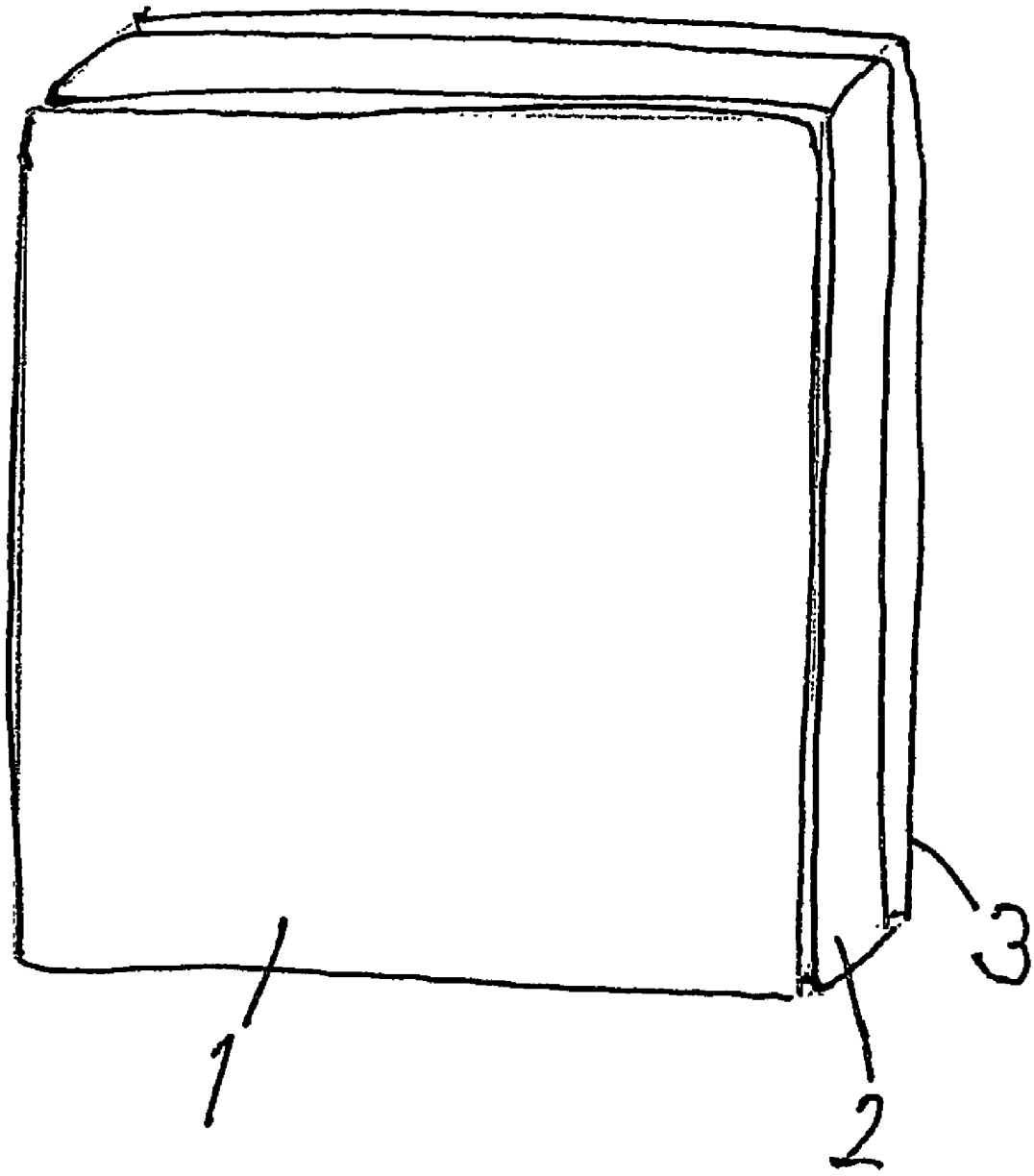
FIG. 1 is a perspective view of protection according to the present invention.

FIG. 1 is a schematic perspective view of the construction of protection according to the present invention. A plate-shaped element of ballistically protective material 1 meets a projectile and on the inside thereof is a container 2 with a liquid. The projectile becomes unstable in its movement through the first element and turns through the liquid container. The projectile is then ideally captured side-on by the internal ballistic protection which is a plate-shaped element 3.

Figure 2:
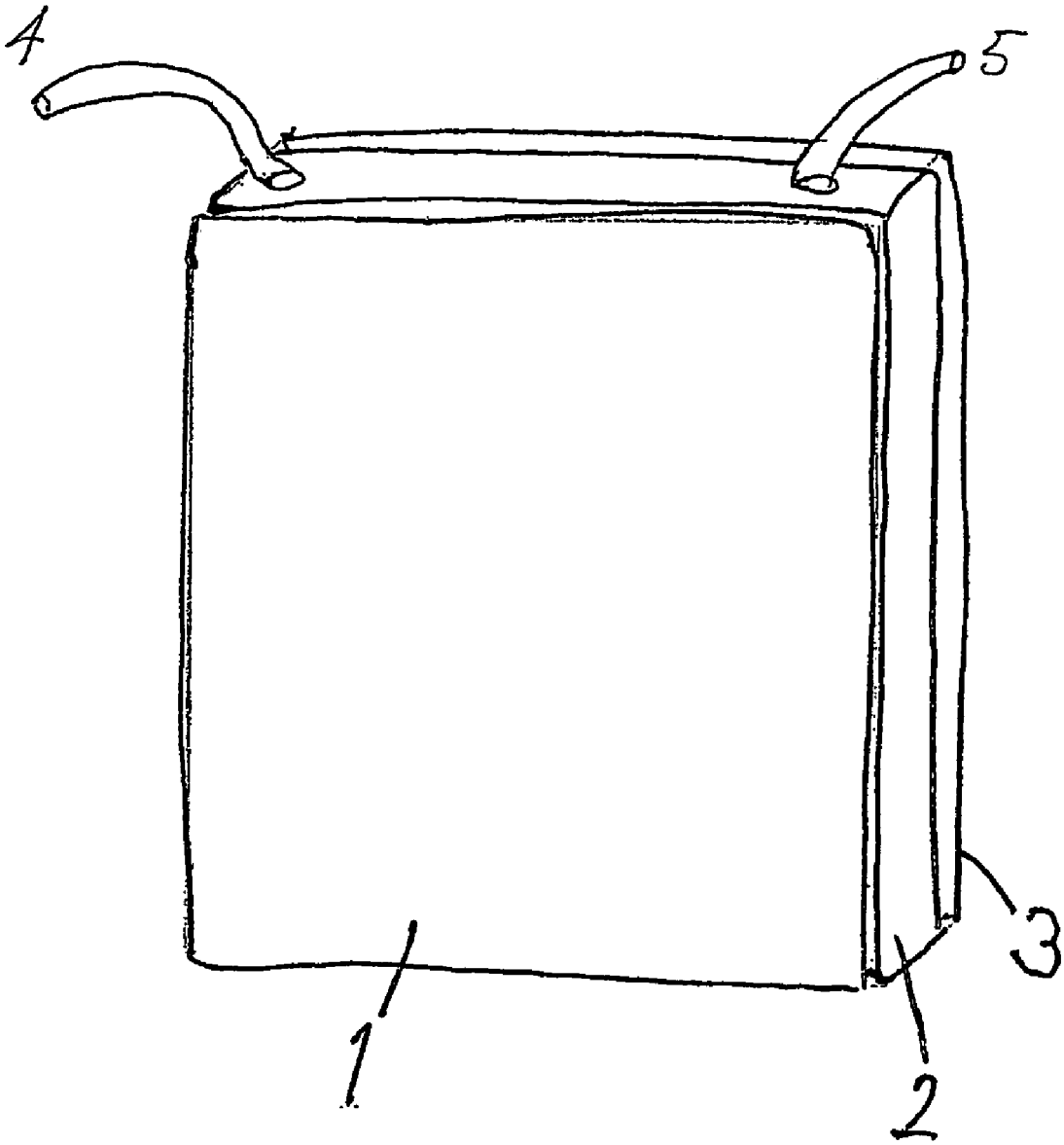
FIG. 2 is a schematic view of protection combined with a drinking water reservoir according to the present invention.

In FIG. 2 there is further illustrated a combination of the protection in FIG. 2 with a drinking water reservoir also according to the present invention. The liquid that is to be drunk is stored in the container 2 and can be filled/drawn off through the connections 4,5. The connection for emptying (4 or 5 respectively) may preferably project down towards the bottom of the container 2.

Figure 3:
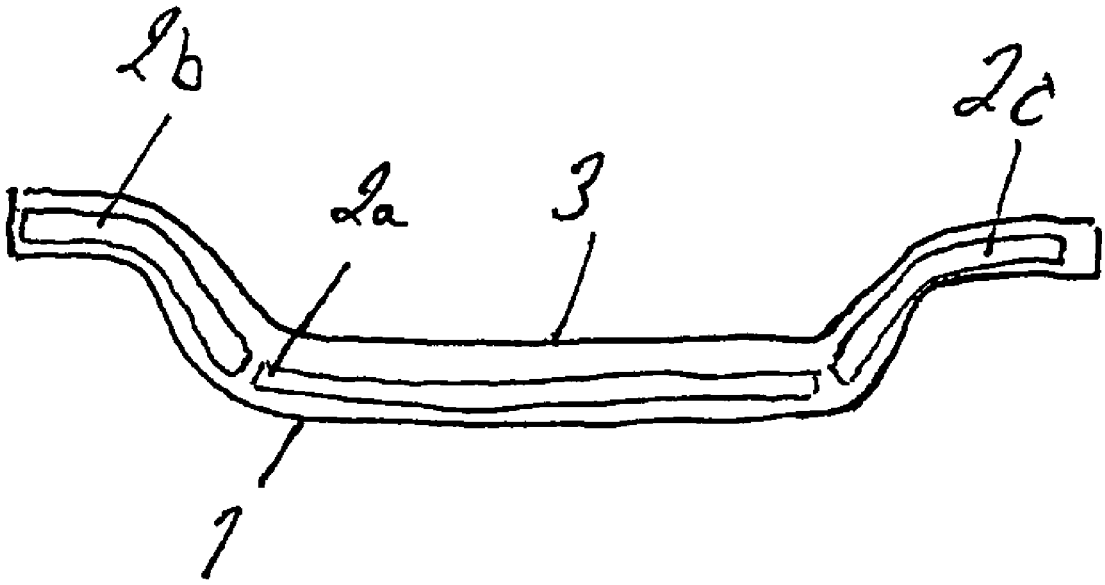
FIG. 3 is a schematic sectional view of protection of a structural part according to the present invention.

In FIG. 3 there is further illustrated an example of how the protection according to the present invention can be employed in a structural part such as a fence element with ballistic protection, panels in vehicles or the like. Between the plate-shaped elements 1 and 3 there are mounted a number of containers 2*a*–*c* containing liquid.

In a vehicle, for example, liquids other than water may be employed and it will also be possible to fill the container with fuel. As illustrated in FIG. 3, the protection may follow the contours of the element being protected.

Figure 4:
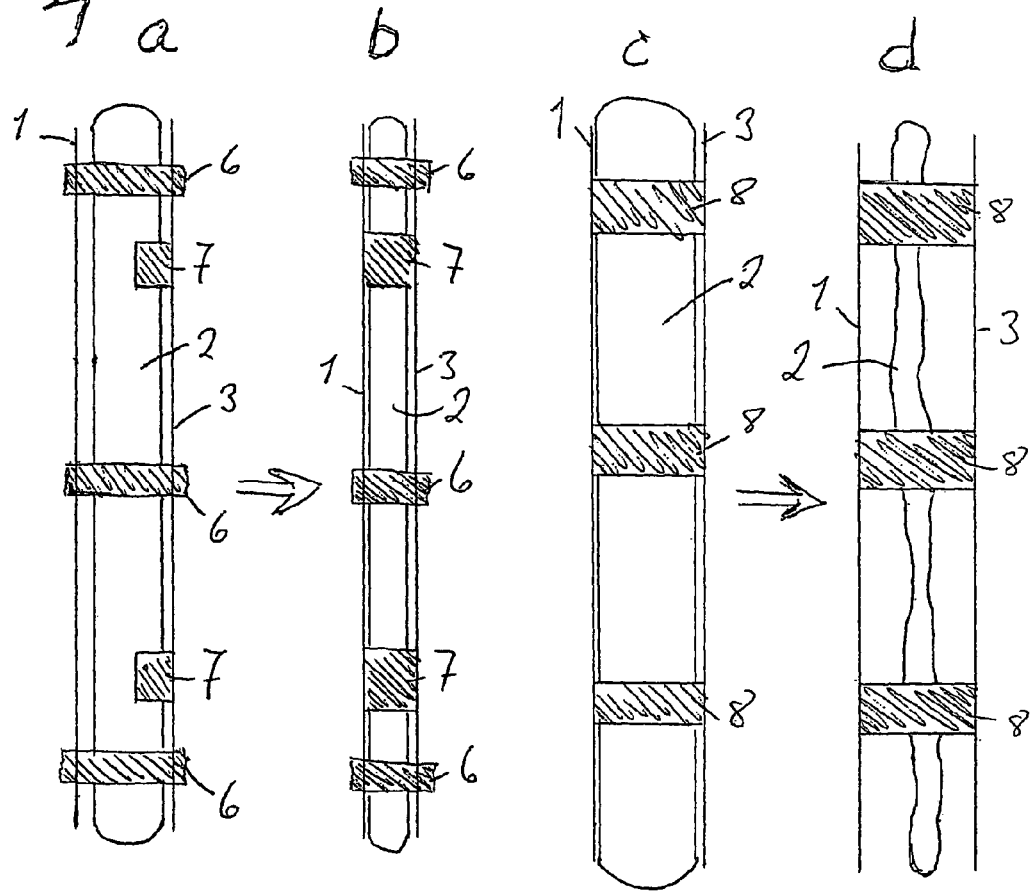
FIGS. 4*a*–4*d* are sectional views of different embodiments of protection and possibly a drinking water reservoir according to the present invention.

In FIGS. 4*a* and 4*b*, moreover, a further embodiment is illustrated where two plate-shaped ballistically protective elements 1 and 3 are drawn together by elastic clips or the like 6. Alternatively, the elements 1 and 3 may be drawn together by placing a pressurised or inflatable elastic bag (balloon) in the adjacent space. This clamps the container (preferably flexible or with flexible portions) together, with the result that it always contains a liquid layer in the area of the protection until the container is almost empty. Furthermore, the contraction can be restricted by distance pieces 7 to prevent contact from being made between the plate-shaped elements 1 and 3. In FIG. 4*a* protection according to the present invention is illustrated with a container 2 which is relatively full. In FIG. 4*b*, moreover, the same protection is illustrated when the container is partly empty and the distance pieces 7 prevent further movement of the plate-shaped elements 1 and 3.

In FIGS. 4*c* and 4*d* protection is illustrated in a similar manner with distance blocks 8 where the container 2 is full in FIG. 4*c* and where the container 2 is almost empty in FIG. 4*d*.

What is claimed is:

1. Ballistic protection suitable for protection against projectiles, splinters, and sharp objects, the protection comprising:

at least two substantially plate-shaped protective elements;

one or more layers of liquid stored in one or more containers; and one or more elastic bodies, wherein the one or more layers of liquid is arranged between the at least two substantially plate-shaped protective elements and wherein the at least two substantially plate-shaped protective elements are drawn towards each other by being connected to the one or more elastic bodies.

2. The protection according to claim 1, wherein the liquid is stored in one or more flexible containers.

3. The protection according to claim 2, wherein a number of the one or more flexible containers at least partly overlap one another.

4. The protection according to claim 2, wherein at least two of the one or more flexible containers are interconnected in a group, wherein the group of interconnected flexible containers comprises a filling and tapping device.

5. The protection according to claim 1, wherein the one or more flexible containers is releasably mounted between the at least two substantially plate-shaped protective elements.

6. The protection according to claim 1, further comprising:

filling means for allowing filling the one or more containers; and tapping means for allowing drinking the one or more layers of liquid.

7. The protection according to claim 6, wherein one or more flexible containers are interconnected in a group, and the group of interconnected flexible containers comprises a filling and tapping device.

8. The protection according to claim 1, further comprising distance pieces arranged to prevent contact from being made between the at least two substantially plate-shaped protective elements.

* * * * *